US007476024B2

(12) United States Patent
Hove et al.

(10) Patent No.: US 7,476,024 B2
(45) Date of Patent: Jan. 13, 2009

(54) PRE-ADJUSTABLE MECHANICAL COLLIMATOR INTERFACE

(75) Inventors: Ulrich Hove, Norderstedt (DE); Volker Onken, Kaltenkirchen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 856 days.

(21) Appl. No.: 10/503,422

(22) PCT Filed: Jan. 27, 2003

(86) PCT No.: PCT/IB03/00234

§ 371 (c)(1),
(2), (4) Date: Aug. 3, 2004

(87) PCT Pub. No.: WO03/067938

PCT Pub. Date: Aug. 14, 2003

(65) Prior Publication Data

US 2005/0184245 A1 Aug. 25, 2005

(30) Foreign Application Priority Data

Feb. 7, 2002 (EP) ..... 02075524

(51) Int. Cl.
*G21K 1/02* (2006.01)
*H05G 1/02* (2006.01)

(52) U.S. Cl. ..... 378/205; 378/147; 378/193

(58) Field of Classification Search ..... 378/147, 378/193, 205

See application file for complete search history.

(56) References Cited

U.S. PATENT DOCUMENTS 2,019,602 A * 11/1935 Findlay ..... 378/202
2,344,543 A * 3/1944 Findlay ..... 378/161
2,542,196 A 2/1951 Haupt
2,998,526 A * 8/1961 Green et al. ..... 378/147
4,464,778 A * 8/1984 Goldmann ..... 378/150
4,905,268 A * 2/1990 Mattson et al. ..... 378/158
5,012,506 A * 4/1991 Span et al. ..... 378/152
5,745,548 A * 4/1998 Dobbs et al. ..... 378/207
6,320,936 B1 * 11/2001 Holland et al. ..... 378/140

* cited by examiner

*Primary Examiner*—Edward J Glick
*Assistant Examiner*—Thomas R Artman

(57) ABSTRACT

The invention relates to a mounting device for mounting a beam manipulating device of an X-ray apparatus to a radiation source of the X-ray apparatus, said mounting device comprising a first mounting flange (10) associated with the radiation source, a second mounting flange (20) associated with the beam manipulating device, and fastening means (60) for fixing the first mounting flange (10) and the second mounting flange (20) to each other. It is an object of the invention to facilitate the alignment of the X-ray beam manipulating device with respect to an X-ray beam path or an X-ray beam focus of the radiation source. To achieve this, the alignment means (30) are adapted to be fastened to the first mounting flange (10), the first mounting flange having a first reference surface (31) which is in a predetermined spaced relationship with respect to the X-ray beam path. The first reference surface (31) corresponds with a second reference surface (34) of the second mounting flange (20). Furthermore, the invention provides a method for mounting a beam manipulating device to a radiation source of an X-ray apparatus.

20 Claims, 2 Drawing Sheets

PRE-ADJUSTABLE MECHANICAL COLLIMATOR INTERFACE

Figure 1:
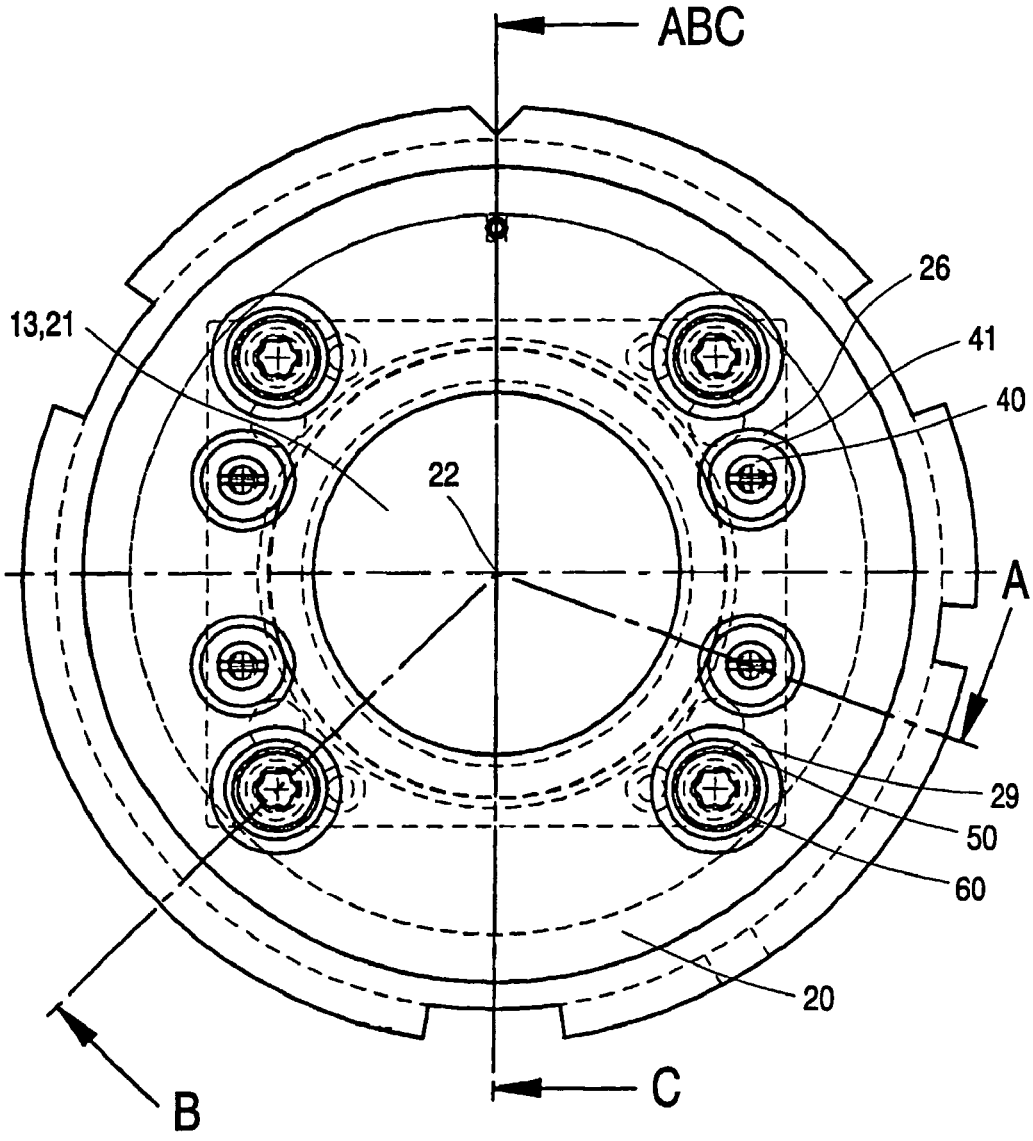

The invention relates to a mounting device for mounting a beam manipulating device of an X-ray apparatus to a radiation source of the X-ray apparatus, said mounting device comprising a first mounting flange associated with the radiation source, a second mounting flange associated with the beam manipulating device, and fastening means for fixing the first mounting flange and the second mounting flange to each other.

It is generally known in the art to manufacture X-ray apparatuses in such a way that the radiation source with its housing and additional devices for manipulating the X-ray beam, such as collimators, diaphragms or shutters, are produced as separate components. Consequently, the separate components have to be mounted to each other.

When mounting a beam manipulating device of an X-ray apparatus to the radiation source of the apparatus it is required to achieve exact alignment of the manipulating device in relation to the radiation source, so as to make sure that the X-ray beam passes from the source and through the manipulating device along a certain path. To achieve this alignment, it is known from U.S. Pat. No. 2,542,196 to provide a certain displaceability of the beam manipulating device with respect to the radiation source. By virtue thereof, the beam manipulating device can be adjusted with respect to the beam, which is emitted by the radiation source. Once the manipulating device has been adjusted with respect to the beam, e.g. the radiation source, it is known to use fastening means, such as screws or bolts, to fasten the manipulating device to the radiation source or the housing of the radiation source.

As described above, the adjustment of the beam manipulating device with respect to the beam has to be performed in a very precise manner. To achieve an exact alignment in the production process, it is known to use auxiliary means for detecting the beam and its direction, to assist in the aligning process. During this process, X-rays and an appropriate X-ray protection room are required for the X-ray-system, as a result of which the process is both time consuming and expensive. Additionally, it is necessary to replace or exchange the X-ray tube, which has a shorter lifetime than the other system components. This replacement or exchange is usually to be performed by a maintenance mechanic, so that auxiliary means used in the production process are not available. As a result, the alignment of the manipulating device with respect to the beam of the system is even more time consuming than during the production process in the factory.

It is an object of the invention to provide a mounting device of the kind mentioned in the opening paragraph which facilitates the alignment of an X-ray beam manipulating device with respect to an X-ray beam path, or with respect to an X-ray beam focus, of a radiation source of an X-ray apparatus.

To achieve this object, a mounting device according to the invention is characterized in that it comprises alignment means adapted to be fastened to the first mounting flange, the first mounting flange having a first reference surface which is in a predetermined spaced relationship with respect to an X-ray beam path of the radiation source and which corresponds with a second reference surface of the second mounting flange. As a result, the first reference surface can easily be adjusted with respect to the path of the X-ray beam in the radiation source. Subsequently, the radiation source and the beam manipulating device can easily be fixed to each other in a precise and adjusted manner by fastening the mounting flanges to each other.

It is an important advantage of the invention that the alignment means can be adjusted with respect to the beam and fixed to the radiation source in the production process of the X-ray apparatus or the radiation source, e.g. the X-ray tube. Once the alignment means are fixed, they do not have to be loosened in subsequent utilization and maintenance procedures. When, in a following step, the beam manipulating device has to be mounted to the radiation source, this can be done in a simple manner without the need of any adjustment, since the alignment of the beam manipulating device with respect to the beam is secured by the fitting of the reference surface of the first mounting flange and the corresponding reference surface of the second mounting flange. Thus, the alignment process is made part of the radiation source production, which is independent of the production of the whole X-ray apparatus. This simplifies the adjustment process during apparatus production.

Another advantage of the invention becomes apparent when the beam manipulating device, or the radiation source, must be replaced while when the X-ray apparatus is located at a customer's site. If, in this case, the beam manipulating device has to be replaced or exchanged for another beam manipulating device, this can be performed without the need of any adjustment, since the alignment means do not have to be loosened and therefore the reference surface of the alignment means remain in alignment with respect to the X-ray beam. By virtue thereof, the replacement beam manipulating device having a corresponding reference surface can simply be mounted to the radiation source of the X-ray apparatus. On the other hand, when the radiation source has to be replaced, this can be done by replacing it with a new radiation source having alignment means with a reference surface adjusted in a predetermined spaced relationship with the X-ray beam of the source. This reference surface or these reference surfaces correspond with the respective surfaces of the second mounting flange of the beam manipulating device which remains in place. By virtue thereof, the new radiation source can be mounted to the beam manipulating device without the need of any adjustment process.

Preferably the first and second reference surfaces are cylindrical. In another preferred embodiment the reference surfaces each comprise at least two plane surfaces which are in angular relationship with each other. The contact area between the reference surface of the first mounting flange and the corresponding reference surface of the second mounting flange must comprise at least two points which are separate from each other and which are capable of transmitting a contact force in directions which are not parallel to each other and not parallel to the direction of the X-ray beam. By this, it is possible to define an exact alignment by these two points with respect to the X-ray beam.

In a preferred embodiment of the invention, the beam manipulating device is a collimator. In other embodiments, the beam manipulating device can be a shutter mechanism or a diaphragm device or any other device which is used to shape, focus, scatter, lead or amplify the X-ray beam.

The invention further relates to an X-ray apparatus with a radiation source, a beam manipulating device and a mounting device for fastening the beam manipulating device and the radiation source to each other, wherein the mounting device is a mounting device according to the invention.

Furthermore, the invention relates to a method for mounting a beam manipulating device to a radiation source of an X-ray apparatus, including the steps of adjusting a first reference surface of alignment means with respect to an X-ray beam path of the radiation source, fastening the alignment means to a first mounting flange associated with the radiation source, fitting a second reference surface, which corresponds with the first reference surface and which is comprised in a second mounting flange associated with the beam manipulating device, to the first reference surface, and fastening the first and the second mounting flange to each other.

This method allows an easy adjustment process to align a beam manipulating device with respect to the X-ray beam of an X-ray apparatus and to fasten this beam manipulating device to a radiation source of the X-ray apparatus.

Figure 2:
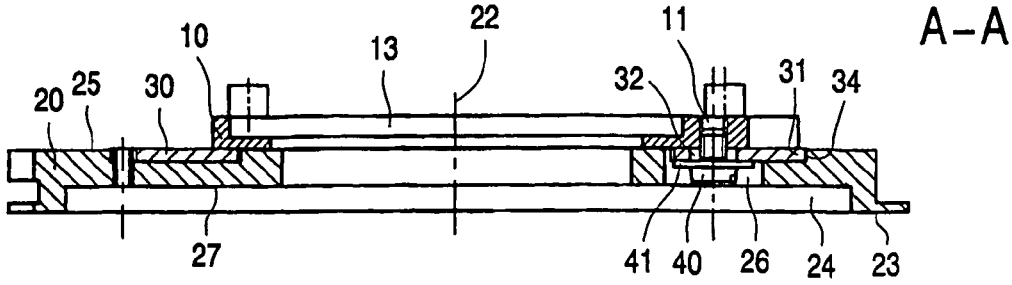
Figure 3:
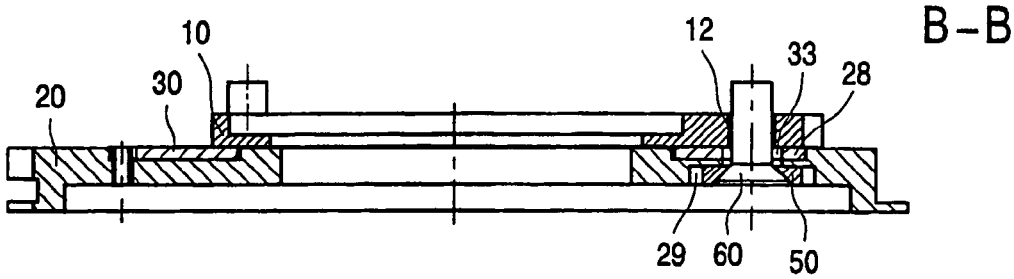
Figure 4:
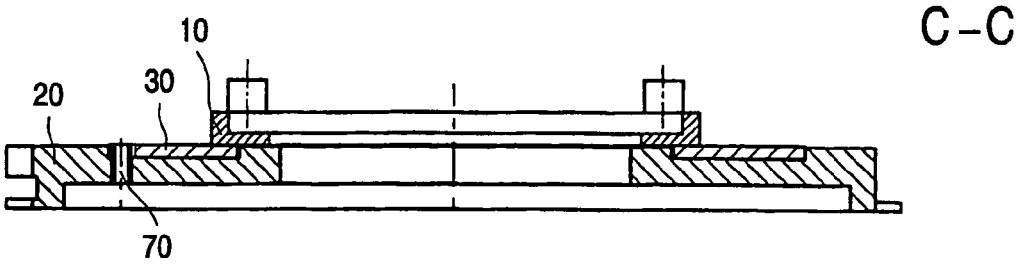

A preferred embodiment of the invention will be described with reference to the Figures, wherein:

FIG. 1 is a front view of a mounting flange associated with a beam manipulating device, FIG. 2 is a cut away side view along line A-A in FIG. 1 of the mounting device according to the invention, FIG. 3 is a cut away side view along line B-B in FIG. 1 of the mounting device according to the invention, and FIG. 4 is a cut away side view along line C-C of FIG. 1 of the mounting device according to the invention.

The embodiment shown in the Figures comprises an annular mounting flange 20 associated with the beam manipulating device (not shown). The mounting flange 20 has a boring 21, the boring 21 and the mounting flange 20 being circularly arranged around a middle axis 22. The mounting flange 20 has a precisely machined outer diameter 24, which fits a collimator which can be mounted to the forepart 23 of flange 20. The opposite forepart 25 of mounting flange 20 comprises an annular recess containing an alignment ring 30. The outer periphery 31 of alignment ring 30 fits exactly in the inner periphery (34) of the annular recess in forepart 25 of mounting flange 20. By virtue thereof, the alignment ring 30 has an exactly defined position relative to the mounting flange 20.

Alignment ring 30 in the annular recess in forepart 25 and the remaining surface of forepart 25 without the recess form a plane surface. A first mounting flange 10 associated with the radiation source of the X-ray apparatus (not shown) is in slidable contact with this plane surface. Consequently, mounting flange 10 is movable in a direction perpendicular to middle axis 22, while staying in contact with the forepart of second mounting flange 20 and/or the forepart of alignment ring 30. The first mounting flange 10 comprises four threaded borings 11. First screws 40 extending through respective borings 32 in the alignment ring 30 can be screwed in the borings 11. When tightening the screws 40, the alignment ring 30 is fastened to the first mounting flange 10. It is important to notice, that the boring 32 in alignment ring 30 is bigger than the outer diameter of the screw 40. Thus, it is possible to move the alignment ring 30 and the first mounting flange 10 towards each other in a direction perpendicular to middle axis 22. Therefore, reference surface 31 can be aligned with respect to the X-ray beam which is emitted through boring 21 in the direction of middle axis 22.

The second mounting flange 20 has four borings extending from the recessed relief 24 to the annular recess in the forepart 25. These borings 26 provide room for the screws 40, so that the head of the screws 40 does not project into the recessed relief 24.

Furthermore, the second mounting flange 20 comprises four borings 28, each having a circular recess 29 facing the recessed relief 24. Each of the circular recesses 29 of borings 28 in the second mounting flange 20 accommodates a circular insert 50. Each circular insert 50 has a centered conical boring accommodating the head of a countersunk head screw 60. The countersunk head screws 60 extend through the borings 28 in the second mounting flange 20 and through a co-axial boring 33 and are screwed into a co-axial threaded boring 12 in the first mounting flange 10.

It is important to notice that borings 28 and 33 are bigger than the outer diameter of the screw 60 and that the diameter of recess 29 is larger than the outer diameter of insert 50. Thus, it is possible to move the second mounting flange 20 and the alignment ring 30 embedded therein into contact with the first mounting flange 10 when the screws 40 are not tightened. Therefore, an alignment of the second mounting flange 20 with respect to the beam of the X-ray apparatus is possible.

Having described the mounting device according to the invention, the method of mounting a beam manipulating device to a radiation source of an X-ray apparatus will be explained as follows:

Mounting flange 10 is associated with the radiation source of the X-ray apparatus (not shown). The X-ray beam of the apparatus passes through boring 13 of the first mounting flange 10 in the direction of the access 22.

In a first step of the method, alignment ring 30 is put on the first mounting flange 10 and the four screws 40 are screwed into the borings 11 but are not tightened.

After this, the reference surface 31 of alignment ring 30 is aligned with respect to the X-ray beam of the apparatus, using for example an auxiliary device for detection of the exact position and direction of the beam. When the reference surface 31 of alignment ring 30 has been adjusted, the ring will not be moved into contact with the first mounting flange 10 anymore. The four screws 40 are then tightened and alignment ring 30 is thereby fastened to the first mounting flange 10.

After this, the second mounting flange 20 of the beam manipulating device (not shown) may easily be adapted to the apparatus and hence is automatically aligned with respect to the X-ray beam. This is achieved by the reference surface 31 which is accommodated in the annular recess in the forepart 25 of second mounting flange 20. A movement of the second mounting flange 20 perpendicularly to the center line 22 is restricted by the fit of the alignment ring 30 in said annular recess.

The second mounting flange 20 may afterwards be fastened to the first mounting flange 10 by inserting the four screws 60 with the four inserts 50 into the borings 28, 33 and into the circular recess 29 and screwing these screws 60 into the threaded borings 12.

The advantage of the above-described mounting device and mounting method resides in that only a lightweight alignment ring has to be adjusted with respect to the path of the X-ray beam. This alignment ring can be fixed in the adjusted position and does not have to be loosened when replacement of either the source or the manipulating device becomes necessary at a later stage. The alignment ring has a reference surface, allowing to fix other devices with respect to the path of the beam in a precise and easy manner. By virtue thereof, there is no need to repeat the adjustment procedure after such a replacement.

It is important to notice that the mounting flanges could either be separate parts of the system, in which case they are fastened to the radiation source or to the beam manipulating device, or be part of the housings of the radiation source or the beam manipulating device.

The invention claimed is:

1. A mounting device for mounting a radiation source of an X-ray apparatus, said mounting device comprising:

a first mounting flange associated with the radiation source, and having a first aperture therethrough, a second mounting flange having a second aperture therethrough and a recess therein, one or more first fastening devices for fixing the first mounting flange and the second mounting flange to each other, an alignment ring adapted to be fastened to the first mounting flange and positioned in the recess of the second mounting flange, and one or more second fastening devices for fixing the alignment ring and the first mounting flange to each other, wherein each of the one or more first fastening devices is separated from the alignment ring and the second mounting flange along a radial direction by one or more first spaces, and wherein a beam of the radiation source passes through the first and second apertures.

2. A mounting device as claimed in claim 1, wherein each of the one or more second fastening devices is separated from the alignment ring and the second mounting flange along a radial direction by one or more second spaces.

3. A mounting device as claimed in claim 2, wherein the one or more second spaces are bores defined through the alignment ring and second mounting flange, and wherein the bores have diameters that are larger than diameters of the one or more second fastening devices.

4. A mounting device as claimed in claim 1, wherein the one or more first spaces are bores defined through the alignment ring and the second mounting flange, and wherein the bores have diameters that are larger than diameters of the one or more first fastening devices.

5. A mounting device as claimed in claim 1, wherein the recess has a size and shape to prevent radial movement of the alignment ring with respect to the second mounting flange.

6. The mounting device of claim 1, wherein the first mounting flange and the alignment ring abut against each other only along a single planar surface.

7. The mounting device of claim 6, wherein the first mounting flange and the second mounting flange abut against each other only along a single planar surface.

8. An X-ray apparatus comprising:

a radiation source, a beam manipulating devices, and a mounting device for fastening the beam manipulating device and the radiation source to each other, wherein the mounting device has a first mounting flange associated with one of the radiation source and the beam manipulating device, a second mounting flange associated with the other of the radiation source and the beam manipulating device, and an alignment ring adapted to be fastened to the first mounting flange, wherein one or more fastening devices fix the first mounting flange, the second mounting flange and the alignment ring to each other, wherein the one or more fastening devices pass through bores in the second mounting ring and the alignment ring, and wherein the bores have diameters that are larger than diameters of the one or more first fastening devices thereby allowing the first mounting flange to slide with respect to the second mounting flange and the alignment ring.

9. The X-ray apparatus of claim 8, wherein the one or more fastening devices are first and second sets of screws, wherein the first set of screws secure the first mounting flange with the alignment ring, and wherein the second set of screws secure the second mounting flange with the alignment ring.

10. The X-ray apparatus of claim 9, wherein the first mounting flange and the alignment ring abut against each other only along a single planar surface.

11. The X-ray apparatus of claim 10, wherein the first mounting flange and the second mounting flange abut against each other only along a single planar surface.

12. The X-ray apparatus of claim 8, wherein the second mounting flange has an annular groove therein, and wherein the alignment ring is positioned in the annular groove.

13. The X-ray apparatus of claim 12, wherein the annular groove has a size and shape to prevent radial movement of the alignment ring with respect to the second mounting flange.

14. A method for mounting a beam manipulating device to a radiation source of an X-ray apparatus, including the steps of:

slidably connecting a first mounting flange to an alignment ring, the first mounting ring being associated with the radiation source;

aligning a beam of the radiation source with the alignment ring by radially sliding the alignment ring with respect to the first mounting flange;

securing the first mounting flange with respect to the alignment ring to prevent any sliding;

securing a second mounting flange to the alignment ring, the second mounting flange being associated with the beam manipulating device.

15. The method of claim 14, further comprising positioning the alignment ring in a groove formed in the second mounting flange.

16. The method of claim 14, further comprising positioning the alignment ring in a groove formed in the second mounting flange to prevent radial movement of the alignment ring with respect to the second mounting flange.

17. The method of claim 14, further comprising providing one or more first fastening devices for securing the first mounting flange and the alignment ring to each other, wherein each of the one or more first fastening devices is separated from the alignment ring and the second mounting flange along a radial direction by one or more first spaces.

18. The method of claim 14, further comprising providing one or more second fastening devices for securing the first and second mounting flanges to each other, wherein each of the one or more second fastening devices is separated from the alignment ring and the second mounting flange along a radial direction by one or more second spaces.

19. The method of claim 14, further comprising abutting the first mounting flange and the alignment ring only along a single planar surface.

20. The method of claim 19, further comprising abutting the first mounting flange and the second mounting flange only along a single planar surface.

* * * * *